United States Patent [19]

Ploussios

[11] Patent Number: 4,509,056

[45] Date of Patent: Apr. 2, 1985

[54] MULTI-FREQUENCY ANTENNA EMPLOYING TUNED SLEEVE CHOKES

[76] Inventor: George Ploussios, 4 Hackney Cir., Andover, Mass. 01810

[21] Appl. No.: 444,493

[22] Filed: Nov. 24, 1982

[51] Int. Cl.[3] ..... H01Q 9/40

[52] U.S. Cl. ..... 343/791; 343/792

[58] Field of Search ..... 343/790, 791, 792, 802, 343/829, 830

[56] References Cited

U.S. PATENT DOCUMENTS

| | | | |
|---|---|---|---|
| 2,218,741 | 10/1940 | Buschbeck | 343/807 |
| 2,487,567 | 11/1949 | Lindenblad | 343/830 |
| 2,533,078 | 12/1950 | Woodward | 343/792 |
| 2,535,298 | 12/1950 | Lattin | 343/802 |
| 2,648,768 | 8/1953 | Woodward | 343/792 |
| 3,293,646 | 12/1966 | Brueckmann | 343/830 |
| 3,588,903 | 6/1971 | Hampton | 343/792 |

FOREIGN PATENT DOCUMENTS

| | | | |
|---|---|---|---|
| 870473 | 6/1961 | United Kingdom | 343/802 |

*Primary Examiner*—Eli Lieberman

[57] ABSTRACT

The invention comprises an antenna capable of effective operation at a number of different frequencies, not necessarily harmonically related, that may be separated in frequency by as little as twenty-five percent. The elements of the antenna are decoupled by loaded coaxial chokes that form part of the active portion of the antenna at the resonant frequency of the chokes. The chokes are loaded with a solid dielectric insert dimensioned so that the inner surface of the shell of the choke and the outer surface of the conductor extending through the choke form a quarter wave shorted transmission line to produce an infinite impedance at the open end of the choke. The chokes may be arranged in series, parallel or series-parallel configurations.

6 Claims, 6 Drawing Figures

MULTI-FREQUENCY ANTENNA EMPLOYING TUNED SLEEVE CHOKES

BACKGROUND OF THE INVENTION

1. Field of the Invention

This invention relates to compact antennas capable of operating efficiently at a number of separate frequencies that need not be harmonically related and which may be relatively close together.

2. Description of the Prior Art

Many types of multiband antennas have been developed, some making use of arrays of antenna elements and some making use of one of various switching arrangements. U.S. Pat. No. 2,535,298 to Lattin describes a simple multiband dipole antenna to which are connected quarter wave sections that function to cause the antenna to resonate at different predetermined frequencies. The central section of the dipole is caused to resonate at the highest frequency of tha antenna and quarter wave sections, measured at this highest frequency, are connected to the ends of this central section. The next highest frequency is determined by the central section of the doublet and the quarter wave sections plus two additional sections, one on the outside of each of the aforesaid quarter wave sections, and, if the antenna is to be adjusted to function at still another frequency, that is, a third frequency, then two additional quarter wave sections, measured at the aforesaid second frequency, are connected to the ends of the antenna adjusted for the second frequency, so that additional sections may be connected to the ends of the latter quarter wave sections to adjust the antenna for the third frequency.

In the Lattin structure, the more less independent radiating sections are achieved by using parallel quarterwave transmission lines as isolating elements. Each quarter wave section consists of a pair of side-by-side spaced conductors that are shorted together at the antenna ends furthest from the central feed point. Additional radiating elements extend from the point where the conductors are shorted to form a radiating section encompassing the entire antenna structure that resonates at a lower frequency than the central dipole antenna. In the structure described by Lattin, the operating length of the dipole at the lower frequency is two or more times the operating length of the dipole at the higher frequency and the antenna is not suitable for use with frequencies separated by a ratio of less than approximately two to one.

U.S. Pat. No. 2,996,718 to Foley describes a broad band monopole antenna consting of a number of concentric layers of conductive materials each having a different length and each coupled to a receiving or transmitting device. The individual elements, however, are not isolated from each other and operation of the antenna is restricted to less than approximately a 2:1 frequency range.

U.S. Pat. No. 2,648,768 to Woodward describes a wideband dipole antenna in which a desired field pattern is maintained by wire radiating or receiving "open loops" connected to the main dipole elements. Improved results are said to be achieved by arranging the auxiliary conductors to extend outwardly at an angle from the primary dipole elements. The antenna is useful over a predetermined frequency range, but is not effective for handling multiple bands at widely separated frequencies.

U.S. Pat. No. 3,139,620 to Leidy and Cubbage describes a multiband coaxial antenna formed by positioning a pair of stubs on a member, the first a predetermined distance to one side and the second a predetermined distance on the other side of the center of a radiating section. Each stub, which is a quarter wavelength long, includes a shorting washer and at its lower edge is connected through the washer to the member and hence at its upper edge presents a high impedance to a first band of frequencies. The stubs are positioned on the member so that the section between the stubs functions as a dipole for transmission of a first band of frequencies. Another pair of tubular stubs are similarly positioned on either side of the center of another radiating section on the member to provide transmission on a second band of frequencies. In a center fed embodiment, a pair of stubs connected shorted edge to shorted edge are located on each end of the antenna to provide a high impedance over a broad band of frequencies. A whip is positioned on one end and the other end of the antenna is grounded.

The choke arrangement used by Leidy and Cubbage is similar to that described by Lattin with the exception that the chokes are coaxially positioned rather than in series. A common disadvantage of these structures is that the exterior of the choke does not form an effective part of the radiating element at the choke resonant frequency. Therefore, the physical length of the antenna is significantly greater than the operating length, which is a multiple frequency dipole arrangement means a size 50% greater than the effective length of the lowest frequency dipole if its separation between the lowest and the next lowest frequency is 2:1 or greater, and much larger if the frequency separation is less than 2:1.

Other antenna constructions have been proposed with various means of isolation to permit operation of the antennas over a relatively broad band of frequencies or at different separated frequencies. In most instances, either the frequencies must be harmonmically related or the efficiency of the antenna is lowered. Many of the structures, while achieving desirable operating characteristics, are either expensive to construct or present bulky or unwieldy structures that are difficult or expensive to mount.

SUMMARY OF THE INVENTION

A multi-frequency antenna is provided that is capable of operating with maximum efficiency at each of several separate frequencies which need not be harmonically related and can be separated by any factor greater than approximately 1.25 to 1.

In an illustrative example, one half of a dipole antenna consists of an extension of the inner conductor of a coaxial transmission line beyond the terminus of the outer conductor. The other half of the dipole consists of the outer surface of a choke formed by a conductive shell surrounding and spaced from the outer conductor of the coaxial transmission line. The end of the shell nearest the feedpoint at the termination of the outer coaxial conductor is shorted to the outer coaxial conductor. The other end of the shell is open. The length of the shell is selected for maximum operating efficiency at the desired frequency. The choke is therefore an active part of the antenna structure.

However, the length of the shell as a result of this selection is not exactly one-quarter wavelength and would permit some energy coupling between the shell and the outer conductor at the open end of the shell.

This coupling increases in importance with antennas designed to handle a large number of frequencies. To adjust the electrical length of the shell to make its inner surface and the surface of the outer coaxial conductor appear as a shorted one-quarter wavelength transmission line, for the purpose of preventing undesired coupling, said dielectric material is placed within the shell and around the outer conductor. The dimensions and dielectric constant of the dielectric material are selected to make the electrical length of the inner surface of the shell precisely one-quarter wavelength. This produces an infinite impedance between the open end of the shell and the outer coaxial conductor thus preventing any coupling at that point. This adjustment by means of loading with dielectric material is made entirely independent of the length of the shell as determined for maximum radiation and reception efficiency.

Multi-frequency operation is accomplished by using a similar decoupling arrangement in a series, parallel or series/parallel arrangement. The arrangement of chokes used in these multi-frequency antennas is always such that complete decoupling is accomplished at a higher operating frequency while coupling is permitted at some lower frequency so that the isolation choke at the higher frequency becomes an active operating element of the antenna at the resonant frequency of the choke.

All of the views are illustrative in nature and do not necessarily represent the physical structure or relate to exact dimensions of such a structure.

DESCRIPTION OF THE PREFERRED EMBODIMENTS

Figure 1:
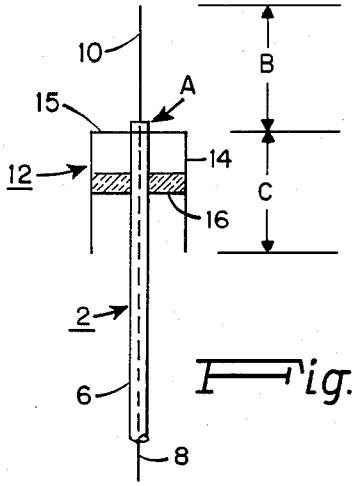
FIG. 1 shows a single frequency dipole illustrating the concept of the invention.

As illustrated by FIG. 1, a coaxial transmission line, generally indicated at 2, is connected to any appropriate transmitting or receiving equipment (not shown). A loaded isolation choke, generally indicated at 12, includes an outer conductive cylindrical shell 14 that is spaced from and surrounds the outer conductor 6. One end of the shell 14 is closed by a conductive end plate 15 that is connected between the end of the shell 14 and the outer coaxial conductor 6. The other end of the shell 14 is open.

The antenna is a dipole, one half of which is formed by an extension 10 of the inner conductor 8 between a feedpoint A and the exposed end of the extension 10. The other half of the dipole is formed by the outer coaxial conductor 6 between the feedpoint A and the shorted end of the choke 12 plus the outer surface of the shell 14. The distances indicated at B and C are each equal to slightly less than one-quarter wavelength at the optimum operating frequency. The inner surface of the shell 14 and the outer surface of the outer coaxial conductor 6 form a transmission line. At the frequency of operation, the effective length of this transmission line is slightly less than one-quarter wavelength and, if used in this manner, would permit some energy coupling at the open end of the choke 12. To lengthen the effective length of this transmission line, a block 16 of solid low-loss dielectric material, such as polystyrene, is positioned between the outer coaxial conductor 6 and the inner surface of the shell 14. The dimensions and dielectric constant of the block 16 of dielectric material are selected to make the electrical length of the transmission line formed by the inner surface of the shell 14 and the outer conductor 6 equal to exactly one-quarter wavelength. The impedance at the open end of the choke 12 is thus infinite and coupling is prevented at that point.

The effective part of the antenna thus extends from the open end of the choke 12 to the end of the extension 10 of the inner conductor 8 with a central feedpoint at A. The length of the outer coaxial conductor 6 below (as shown in FIG. 1) the open end of the choke 12 thus does not form an active element of the antenna.

In the other illustrations corresponding elements are indicated by similar numbers followed, where appropriate, by letter suffixes.

Figure 2:
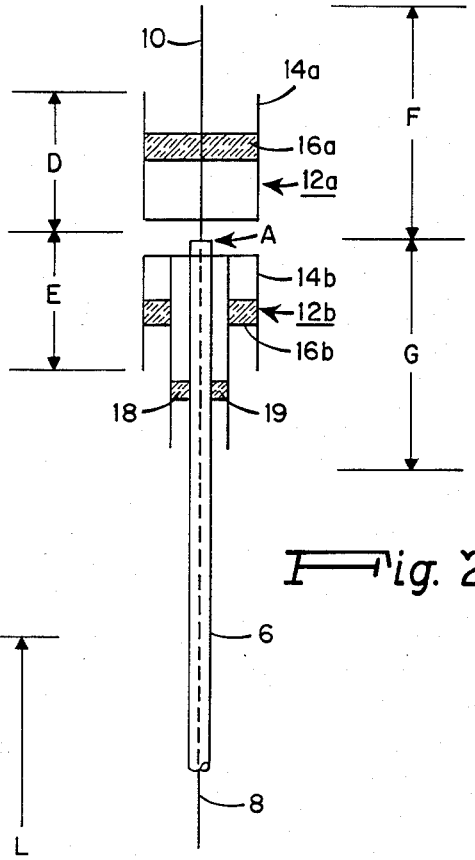
FIG. 2 illustrates a dual band dipole utilizing the principles set forth in connection with FIG. 1.

FIG. 2 shows a dual frequency antenna utilizing two loaded isolation chokes, generally indicated at 12*a* and 12*b* each constructed in the manner of choke 12 already described. In this construction, the coaxial transmission line 2 is connected to the feedpoint A where the outer conductor 6 terminates. The extension 10 of the inner conductor 8 extends beyond the end of the outer conductor 6 through the choke 12*a* and for a predetermined distance beyond. The chokes 12*a* and 12*b* are respectively loaded by blocks 16*a* and 16*b* of dielectric material.

At the highest frequency of operation, the two chokes 12*a* and 12*b* act as quarter wavelength sections of a first dipole antenna centered around the feedpoint A, the quarter wave sections being indicated by the distances D and E respectively. These lengths are selected for maximum operating efficiency at the highest frequency of operation. The dielectric block 16*a* adjusts the electrical length of the transmission line formed by the inner conductor 8 and the inner surface of the shell 14*a* to precisely one-quarter wavelength at the highest frequency of operation. The impedance presented at the open end of the choke 12*a* is thus infinite so there is no coupling at that point between the shell 14*a* and the conductor 8. The inner surface of the shell 14*b* and the conductor 6 form a similar shorted quarter wavelength transmission line.

At some lower frequency, separated by approximately 25% or more from the first frequency, which need not be harmonically related to the operating frequency of the dipole section just described, three chokes in conjunction with the extension 10 and a portion of the outer coaxial conductor 6 form a second dipole, centered around the feedpoint A, as represented by the distances F and G. The first section of this dipole is formed by the outer surface of the choke 12*a* and the extension 10 of the inner conductor 8 that extends beyond the end of the choke 12*a* as indicated by the distance F. The second dipole half extends from the open end of an isolation choke 18 to the feedpoint A, as represented by the distance G, and includes the exposed portion of the choke 18 and the outer surface of the shell 14*b*. The decoupling choke 18 is adjusted by means of the dielectric block 19 to form a shorted quarter wavelength transmission line at the lowest operating frequency. This decoupling choke 18 is part of the radiating structure, but the decoupling at the same point may be accomplished by a separate decoupling device using any of the known techniques such as those in which the decoupling element is not part of the radiating structure.

Figure 3:
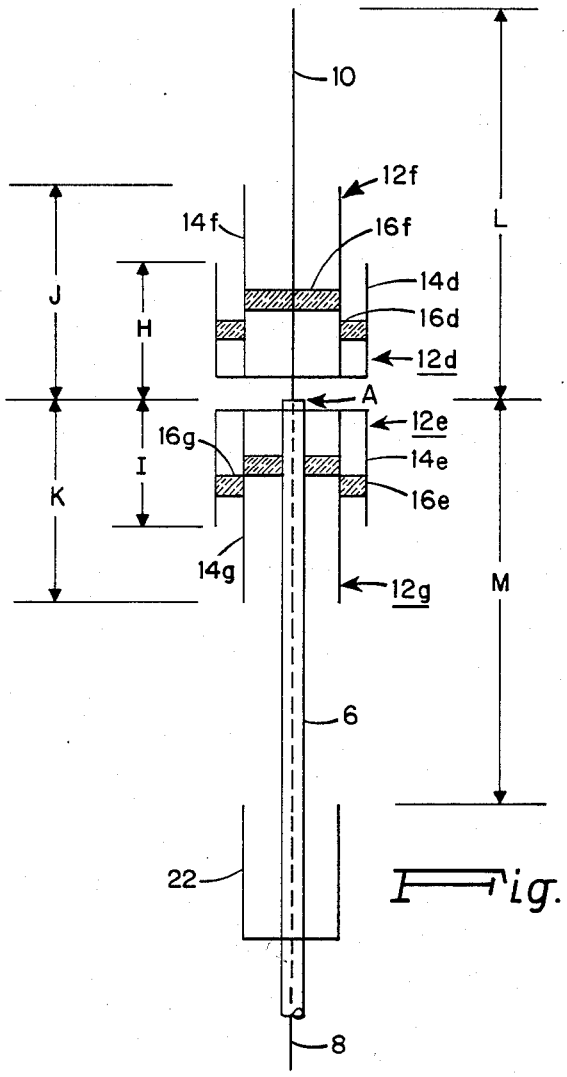
FIG. 3 illustrates a dipole antenna using similar principles capable of operating at three separate frequencies.

FIG. 3 shows a parallel arrangement of the chokes in an antenna capable of operation at three separate frequencies. At the highest frequency of operation, the open ends of the shells 14*d* and 14*e* of chokes 12*d* and 12*e* define the ends of a dipole section centered at the feedpoint A as indicated by the dimensions H and I. As previously described, each of these chokes forms a transmission line at the highest frequency of operation that is adjusted by the dielectric blocks 16*d* and 16*e* to produce an infinite impedance at the respective open ends of the chokes to prevent coupling at these points between the shells 14*d* and 14*e* and the conductor within the respective choke.

At the next lower frequency of operation, the ends of a dipole are defined by the open ends of the chokes 12*f* and 12*g*. The cylindrical shell 14*f* of choke 12*f* is positioned partially within the shell 14*d* of choke 12*d* and extends beyond the open end of the shell 14*d*. Similarly, the shell 14*g* of the choke 12*g* extends through and beyond the open end of the shell 14*e* of the choke 12*e*. This dipole is represented by the dimensions J and K extending on each side of the feedpoint A. At this lower frequency, the shells 14*d* and 14*e* are no longer a quarter wavelength so coupling occurs at the open ends of these chokes. The first half of this dipole thus includes the extension 10 of the inner conductor 8 between the feedpoint A and the closed ends of chokes 12*d* and 12*f*, the outer surface of the shell 14*d* of the choke 12*d*, and the outer surface of the shell 14*f* from the open end of the choke 12*d* to the open end of the choke 12*f*. The other dipole section is formed in a similar manner by the length of outer conductor 6 between the feedpoint A and the closed ends of the shells 14*e* and 14*g* plus the outer surface of shell 14*e* and the exposed portion of the shell 14*g*.

The inner surface of the shell 14*f* of the choke 12*f*, together with the extension 10 of the conductor 8, forms a transmission line that is adjusted to present infinite impedance at its open end, at this second frequency, by its dielectric block 16*f*. The corresponding arrangement of choke 12*g* prevents coupling between the open end of the shell 14*g* and the outer conductor 6.

At a third and still lower operating frequency, one-half of the dipole is represented by the distance from the feedpoint A to the end of the extension 10 as indicated by the dimension L. Neither of the chokes 12*d* or 12*f* forms an effective isolation element at this lower frequency, so the outer surfaces of the shells 14*d* and the exposed surface of the shell 12*f* in conjunction with the exposed portions of the extension 10 form one-half of a resonant dipole element.

The other element of this dipole extends from the feedpoint A to the open end of a decoupling choke 22 as indicated by the dimension M. This dipole element includes the exposed portions of the outer conductor 6, the outer surface of the shell 12*e* and the exposed outer surface of the shell 12*g*.

The low frequency decoupling can advantageously be accomplished by using a choke such as the choke 18 of FIG. 2. It is possible also to use a choke, such as the choke 22 that does not form part of the radiating structure or other means already known may be used to accomplish the decoupling.

Figure 4:
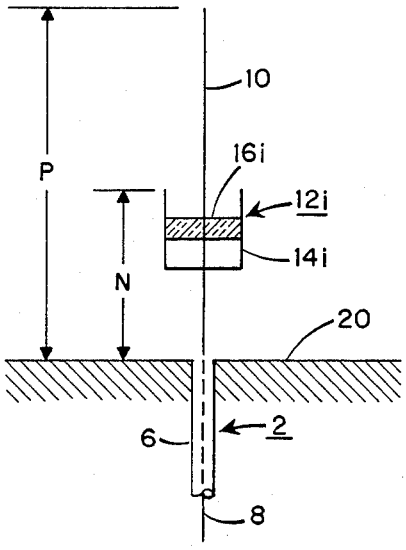
FIG. 4 illustrates a monopole antenna capable of operating at dual frequencies.

FIG. 4 illustrates a dual frequency monopole antenna in which the outer conductor 6 of the coaxial feed line 2 is connected to a ground plane 20 and the extension 10 of the inner conductor 8 extend from the ground plane through a choke 12*i* to form a radiating section as indicated by dimension N. As in the earlier examples, the choke 12*i* is partially filled with dielectric material 16*i* that is dimensioned so that the choke forms a quarter wavelength transmission line and prevents coupling between the shell 14*i* and the extension 10 at the open end of the choke at the highest frequency.

At some lower frequency of operation, the choke 12*i* becomes ineffective as an isolation element and the entire length of the structure from the ground plane to the end of the conductor, as indicated at P, becomes a monopole antenna at the lower resoanant frequency.

Figure 5:
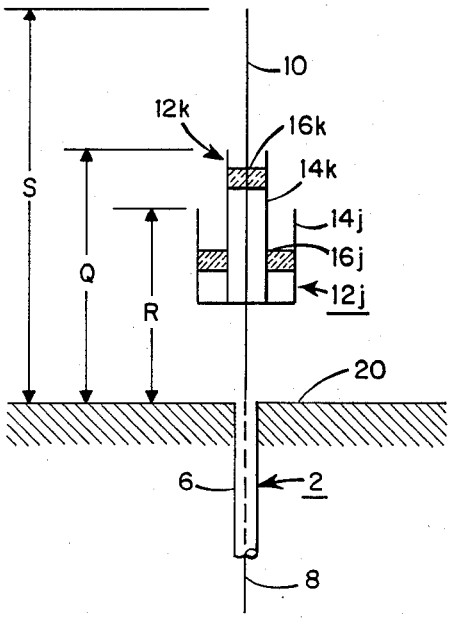
FIG. 5 illustrates a monopole antenna capable of operation at three separate frequencies.

FIG. 5 illustrates the use of two parallel chokes to form a monopole capable of operating at three separated frequencies. As in the previous example, the extension 10 of the inner conductor 8 of the coaxial line 2 extends from a ground plane 20. A first choke 12*j* is adjusted, as in the earlier example, so that the inner surface of the shell 14*j* and the outer surface of the shell 14*k* form a quarter wave shorted transmission line at the highest frequency of operation. The structure above the open end of the choke 12*j* is thus decoupled and the active part of the antenna extends from the ground plane 20 to the open end of the choke 12*j* as indicated by dimension R.

The choke 12*k* is positioned within and extends through the choke 12*j* and is arranged, as previously described, to provide isolation, at the next highest frequency of operation, at the open end of the choke 12*k*. At this operating frequency, the resonant antenna structure extends from the ground plane to the open end of the choke 12*k* as indicated by the dimension Q.

At a third and lower operating frequency, neither of the chokes is effective in providing isolation so the entire structure from the ground plane 4 to the end of the extension 10 functions as a monopole antenna.

Figure 6:
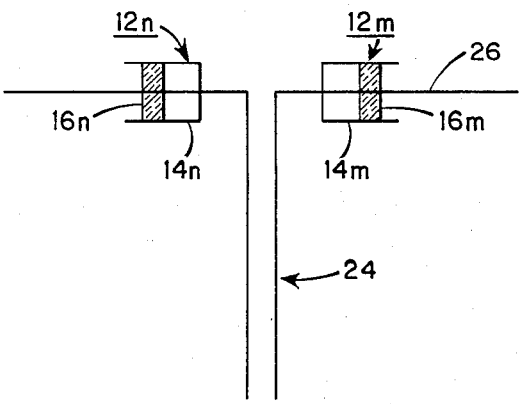
FIG. 6 illustrates a dual frequency antenna fed with a two wire line.

The concept of isolation chokes as active elements of a multi-frequency antenna can be applied to antennas other than those fed by a coaxial transmission line. For example, FIG. 6 illustrates a dipole antenna fed by a balanced transmission line 24. A choke 12*m* having a cylindrical shell 14*m* is positioned around one arm 26 of a dipole antenna and a similar choke 12*n* is positioned around the other element 28 of the dipole. As in the previous examples, the closed ends of the chokes are positioned nearest the feedpoint. The distance between the open ends of the two chokes is adjusted for optimum operation at the highest frequency. The two chokes are adjusted by means of the dielectric blocks 16*m* and 16*n* to produce an infinite impedance at the open ends of the two chokes. At the lower operating frequency, the chokes are ineffective in decoupling the signal and the full lengths of the dipole arms become active antenna elements. Additional chokes, in either series or parallel arrangements, may be added to provide for operation at a greater number of frequencies.

From the foregoing it will be seen that the invention provides an antenna capable of efficient operation at a number of frequencies that need not be widely separated, that may be constructed in a myriad of different forms to best adapt it for each particular application, and which may be economically and readily constructed by ordinary manufacturing processes.

I claim:

1. A multi-frequency antenna system capable of efficient operation at a plurality of frequencies comprising
a feedline having a predetermined feedpoint,
a first radiating section resonant at a first operating frequency including
a coaxial choke assembly having
an inner conductor connected to said feedline, and
an outer conductive cylindrical shell surrounding and spaced from said inner conductor and having an open end and a closed end, said closed end being connected electrically to said feedline, the open end of said shell being directed away from said feedpoint and defining one end of said first radiating section and arranged so that said shell forms an active radiating element of said first section at said first operating frequency,
dielectric material partially filling said space between said outer shell and said inner conductor and being adjusted to cause the inner length of said choke assembly to be precisely one-quarter wavelength at said first operating frequency, and
a second radiating section including
said first radiating section, and
an additional element formed by an extension of said inner conductor and extending beyond the open end of said choke, said second radiating section being resonant at a second operating frequency lower than said first frequency.

2. An antenna system as claimed in claim 1 wherein said second radiating section includes
a second coaxial choke assembly having an inner conductor formed by said additional element, and
an outer cylindrical shell surrounding and spaced from said inner conductor of said second choke assembly and having a closed end and an open end, the open end being directed away from said feedpoint, said second choke assembly being arranged to form a shorted quarter wavelength transmission line at said second frequency of operation.

3. An antenna system as claimed in claim 2 including
a third coaxial choke assembly having
an inner conductor connected to said feedline, and
an outer conductive shell surrounding and spaced from said inner conductor and having an open end and a closed end, and
a fourth coaxial choke assembly having
an outer conductive shell surrounding and spaced from said outer shell of said third coaxial choke assembly and having an open end and a closed end, said open ends of said outer shells of said third and fourth choke assemblies being directed away from the said open ends of said outer shells of said first and second choke assemblies.

4. An antenna system as claimed in claim 1 including
a second coaxial choke assembly having
an inner conductor connected to said feedline, and
an outer shell surrounding and spaced from said inner conductor and having an open end and a closed end, said closed end being connected to said feedline, and
a third coaxial choke assembly including an outer cylindrical shell surrounding and spaced from said outer shell of said second choke assembly and having an open end and a closed end, said open ends of said second and third choke assemblies being directed away from said feedpoint.

5. An antenna system as claimed in claims 3 or 4 wherein
each of said choke assemblies includes dielectric material just sufficient to adjust the effective length of such choke assembly to one-quarter wavelength at one operating frequency of said antenna system.

6. An antenna capable of operating at multiple frequencies including a first and a second frequency comprising
a coaxial feed line having an inner and an outer conductor,
an extension connected to said inner conductor and extending beyond said outer conductor, the termination of said outer conductor defining a feedpoint,
a first coaxial choke having an outer shell with an open end and a closed end, said shell of said first choke being positioned around and spaced from said extension on one side of said feedpoint,
a second coaxial choke having an outer shell with an open end and a closed end, said shell of said second choke being positioned around and spaced from said outer conductor on the opposite side of said feedpoint from said first coaxial choke,
the open end of each of said chokes being directed away from said feedpoint, and
solid dielectric material partially filling each of said chokes,
each of said chokes forming a shorted quarterwave transmission line at said first operating frequency.

* * * * *